US006942121B1

(12) United States Patent
Northup et al.

(10) Patent No.: US 6,942,121 B1
(45) Date of Patent: Sep. 13, 2005

(54) COMMERCIAL CONTAINER DRINKING ADAPTER FOR JUVENILE USE AND DRINKING SYSTEM

(76) Inventors: David Northup, 12098 Calle Naranja, El Cajon, CA (US) 92019; Cheryl Northup, 12098 Calle Naranja, El Cajon, CA (US) 92019

( * ) Notice: Subject to any disclaimer, the term of this patent is extended or adjusted under 35 U.S.C. 154(b) by 0 days.

(21) Appl. No.: 10/354,254

(22) Filed: Jan. 29, 2003

Related U.S. Application Data

(60) Provisional application No. 60/353,462, filed on Jan. 31, 2002.

(51) Int. Cl.[7] ..... A47G 19/22
(52) U.S. Cl. ..... 220/714; 220/303
(58) Field of Search ..... 220/303, 714, 220/717, 490, 494; 215/311, 387, 11.4, 11.6

(56) References Cited

U.S. PATENT DOCUMENTS 3,990,596 A * 11/1976 Hoftman ..... 215/11.1
4,898,291 A * 2/1990 Sailors ..... 215/11.4
5,213,236 A 5/1993 Brown et al.
5,273,172 A 12/1993 Rossbach et al.
5,295,597 A * 3/1994 Green ..... 215/11.4
5,467,888 A * 11/1995 Brandstrom et al. ..... 220/319
5,577,647 A * 11/1996 Pittarelli et al. ..... 224/148.6
5,791,503 A * 8/1998 Lyons ..... 215/11.5
5,944,234 A * 8/1999 Lampe et al. ..... 222/490
6,059,132 A 5/2000 Benjamin
6,102,245 A 8/2000 Haberman
6,202,877 B1 3/2001 La Torre et al.
6,269,968 B1 8/2001 Belcastro
6,290,090 B1 9/2001 Essebaggers

* cited by examiner

*Primary Examiner*—Derris H. Banks
*Assistant Examiner*—J Williams
(74) *Attorney, Agent, or Firm*—Nath & Associates; Robert P. Cogan

(57) ABSTRACT

A drinking adapter for juvenile use includes a closure member releasably engaged to a beverage container. The closure member comprises a cap, and a mouthpiece controls flow of fluid out of the container. A handle is supported to the closure member.

10 Claims, 6 Drawing Sheets

COMMERCIAL CONTAINER DRINKING ADAPTER FOR JUVENILE USE AND DRINKING SYSTEM

This application claims the benefit of priority of provisional patent application 60/353,462, filed Jan. 31, 2002.

FIELD OF THE INVENTION

The present invention relates to an adapter for drinking from commercially available beverage containers for juvenile use and a system incorporating said adapter.

BACKGROUND OF THE INVENTION

Juvenile drinking cups are well-known in the art. These cups comprise beverage containers and covers. The covers commonly comprise various sorts of mouthpieces formed in a top with the top comprising a valve. Such containers must be filled through one of a number of sources. The cup must be cleaned as well the rest of apparatus between uses. The cups may or may not have various forms of handles for facilitating manipulation by a user.

Use of such cups involves inconvenience when used away from home. The entire cup system must be transported and when the child is finished drinking, unless cleaning facilities are conveniently at hand the cup must be taken home dirty.

It would greatly simplify the task of providing for drinking on behalf of a child by providing a system which is engageable with a commercially available container such as a carbonated soft drink container or a spring water container. A system that does not include a cup with handles would also need to have a form of handle included in a drinking adapter so that a user such as a young child may conveniently hold the container and manipulate it for use.

SUMMARY OF THE INVENTION

It is therefore a general particular advantage of the present invention to provide a beverage container adapter for juvenile use which may be affixed to a container once the container closure has been removed.

It is another particular advantage of the present invention to provide a device of the type described in which a holder is combined with the drinking adapter for manipulation by a child.

It is a further specific particular advantage of the present invention in one form to provide a handle which is formable into a selected shape for amusement for the child and for use as licensed merchandise.

It is another specific particular advantage of the present invention to provide a handle of the type described shaped to allow teething and to avoid choking hazards.

It is a further particular advantage of the present invention to provide an integrated drinking system for use by a juvenile.

Briefly stated in accordance with the present invention, there is provided a drinking system including a cap suitable for engaging an open beverage container. The cap and a mouthpiece are incorporated in a closure member. Built into the cap is a valve which may be operated by sucking on the mouthpiece. The closure member is surrounded by a handle for manipulation of the assembly of the drinking container and the adapter by a user, such as a child.

BRIEF DESCRIPTION OF THE DRAWINGS

The invention, both as to its matter and organization and manner of operation may be further understood by the following description taken in connection with the following drawings.

Of the drawings.

DETAILED DESCRIPTION OF THE INVENTION

Figure 1:
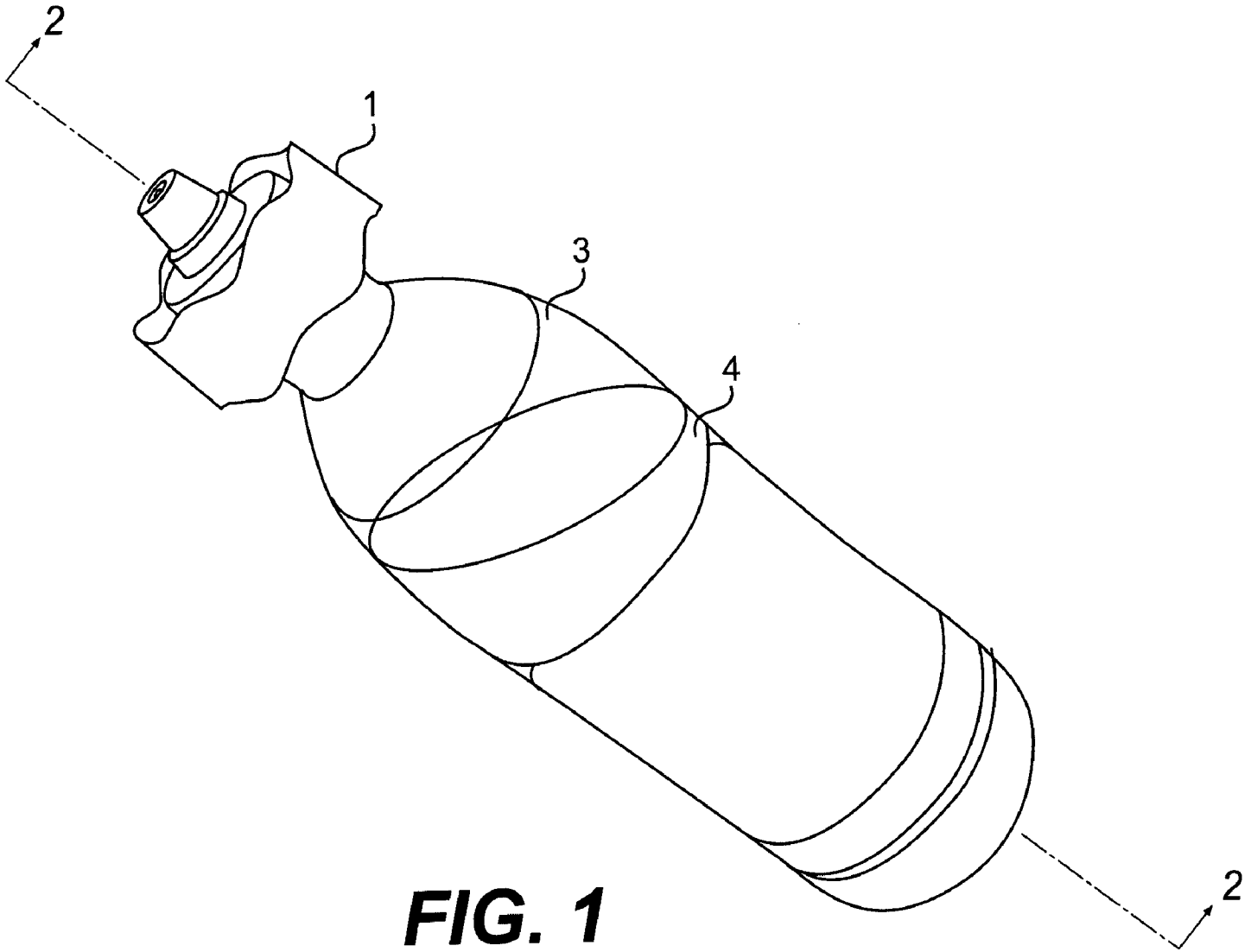
FIG. 1 is a axonometric view of a system according to the present invention integrated with a commercially available drinking container.
Figure 2:
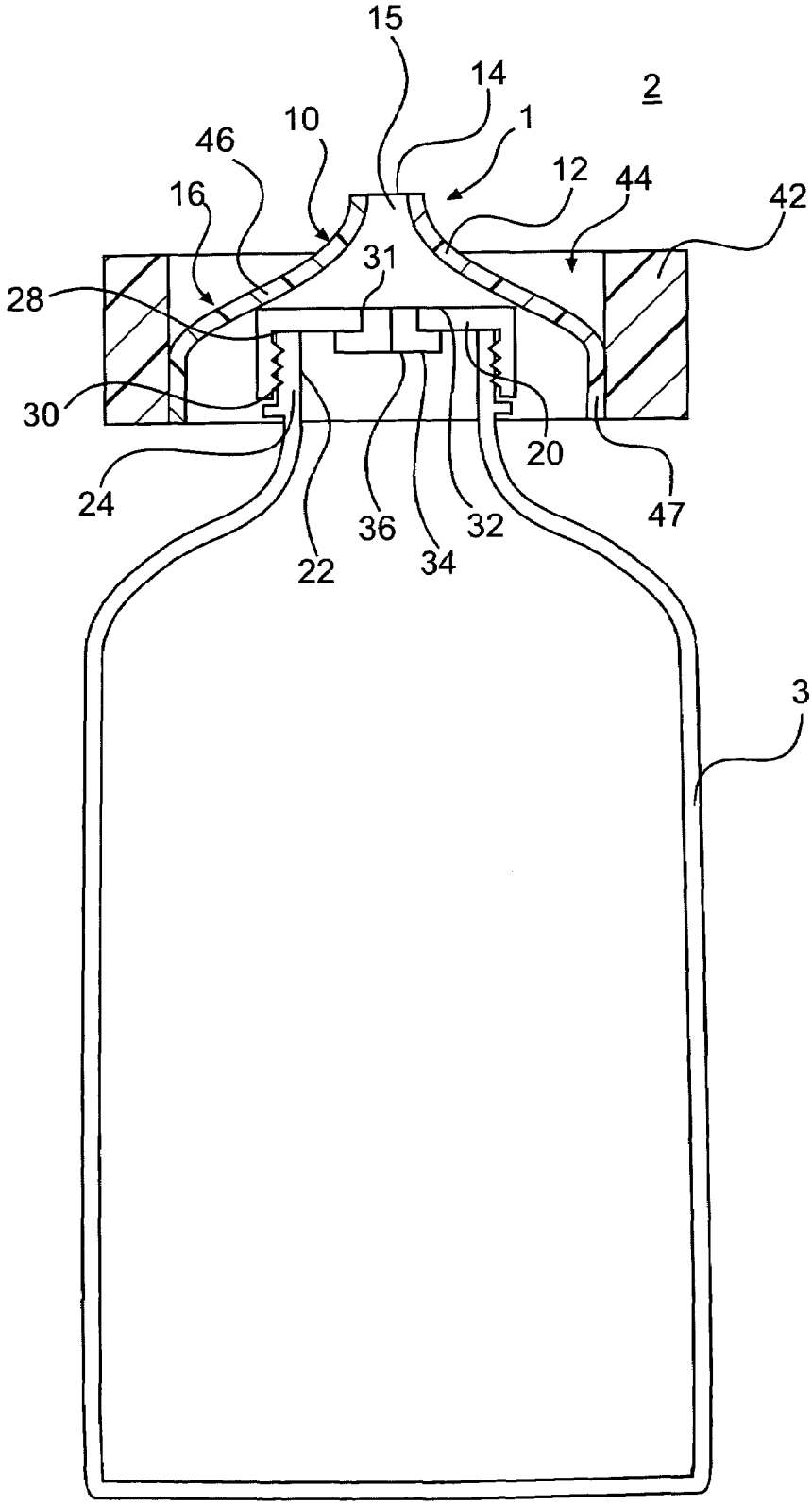
FIG. 2 is a cross-sectional elevation of the apparatus in FIG. 1 taken along lines 2—2 of FIG. 1.

FIGS. 1 and 2 illustrate a drinking adapter 1 constructed in accordance with the present invention and a drinking system 2 comprising a drinking adapter 1 and commercially available beverage container 3 which may hold liquid 4. FIG. 1 is an axonometric view, and FIG. 2 is a cross-sectional view taken along lines 2—2 of FIG. 1. The drinking system of FIG. 1 comprises a closure member 10 having a mouthpiece 12 including an aperture 14 at an upper portion thereof and a member 16 at a lower end thereof. The mouthpiece 12 encloses a volume 15 exterior to the container 3. The terms upper and lower are arbitrary. Upper as used here means away from a closed end of the beverage container 3, and lower means toward the closed end. Radial and axial directions are with respect to a vertical axis 19 of the beverage container 3.

An opening 20 is normally at an upper end of the beverage container 3 surrounded by a neck 22 having outer threads 24. The cap portion 16 has an axial dimension which may approximate that of the neck 22. It is desirable to provide a dimension that is easy for a user to handle. If the beverage container 3 is asymmetrical, then the axis 19 may be that of the opening 20.

Many well-known shapes may be used for the mouthpiece 12. The mouthpiece 12 can include a substantially axial extension around which a child can place both teeth and lips. The mouthpiece 12 could alternatively comprise a tube or other convenient shape. Affixed to the closure member 10 below the mouthpiece 12 is a cap 28 which among other things will serve as a cap to close and releasably engage the beverage container 3. The cap 28 includes threads 30 for releasably engaging the threads 24 of the beverage container 3. One or more forms of cap 28 maybe provided. The form depends on the sort of container 3 being utilized.

Among common soft drink containers, there is one generally standard thread of a selected pitch for plastic containers bearing plastic caps and a different thread for glass containers normally receiving "twist" off steel caps. Preferred forms of the invention will include the cap 28 having threads 30 suitable for meshing with a plastic container 3. Normally plastic will be preferred to glass due to child safety issues. However, for applications in which the assembly 2 will be used only in the environment of deep pile carpeting, a glass beverage container 3 may be suitable for use. The threads 24 of the container 3 and threads 30 of the cap 28 could be replaced by other releasable engaging means, e.g., a bayonet connection. Threads 30 are preferred as a means of providing releasable engagement due to the prevalence of threads 24 on containers 3.

Figure 3:
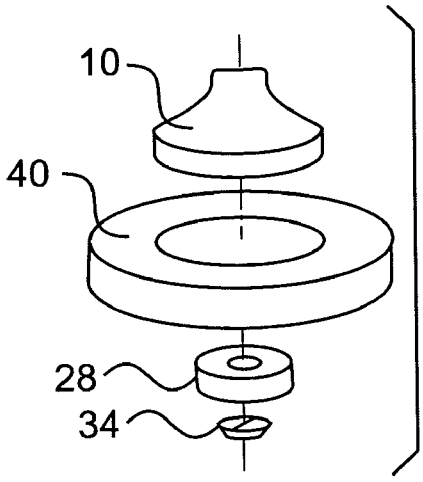
FIG. 3 is an exploded view of the valve means, cap and mouthpiece of one form of the apparatus.

As seen in FIG. 2 and also as better seen in FIG. 3, which is an exploded view in axonometric form of the elements of FIG. 2, the cap 28 contains a valve 34 which closes an aperture 31 in an upper surface 32 of the cap 16. The valve 34 is preferably made of an elastomer and has a slit 36 formed therein. The cap 16 communicates a volume inside the containers 3 with an exterior volume, e.g., the volume 15 in the mouthpiece 12. When suction is applied to the mouthpiece 12, the valve 34 deforms so that liquid 4 passes through the slit 36. When no such suction is applied, the valve 34 remains closed.

In order to provide further functionality, the drinking adapter 1 further comprises a handle 40. With the handle 40, the system 2 may be grasped by a user whether or not the container 3 has a handle. Consequently, a juvenile user may support the system with one hand even if a user could not hold the container 3 with one hand. In the present invention, the handle 40 comprises a ring 42. The ring 42 is a hollow, right, cylindrical solid having an inner diameter selected to mate with the cap member 16. Specific dimensions of the ring 16 may be selected to correspond to the hand size of a user. The ring 42 provides for more surface area for a user to hold than the closure member 10 and allows a user greater freedom in manipulation of the system 2.

The handle 40 need not be symmetrical, nor need it contact the closure member 10 around its entire periphery. A support member 46 supports the handle 40 to the closure member 10. The handle 40 may be press fit over a leg member 47 extending axially from the support member 46. Alternatively the handle 40 may be secured to the support member 46 by adhesive or may be manufactured unitarily with the closure member 10 and support member 46.

Figure 4:
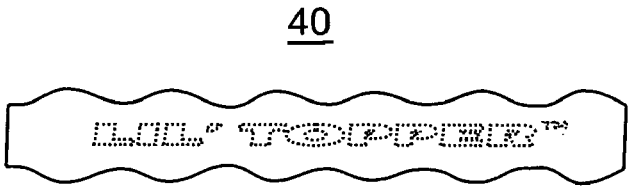
FIG. 4 is an axonometric view of an alternative form of ring by which the user may manipulate the system of the present invention.

FIG. 4 is an elevation of a further form of the handle 40. Upper and lower peripheries of the handle 40 may be given ornamental shapes, either for greater ease of use by a child or simply for amusement. As illustrated in the present embodiment, axially displaced ends of the handle 40 have substantially sinusoidal borders. The handle 40 may also be shaped to display forms of animals or characters, making the drinking adapter 1 particularly suitable for use as licensed merchandise. Alternatively, the handle 40, as indicated in FIG. 4, may simply be imprinted with indicia 50 such as promotional material. Consequently, the system could be branded with indicia of a theme park at which the drinking adapter 1 may be sold. The handle 40 may also be associated with movies, cartoons or theater productions.

Figure 5:
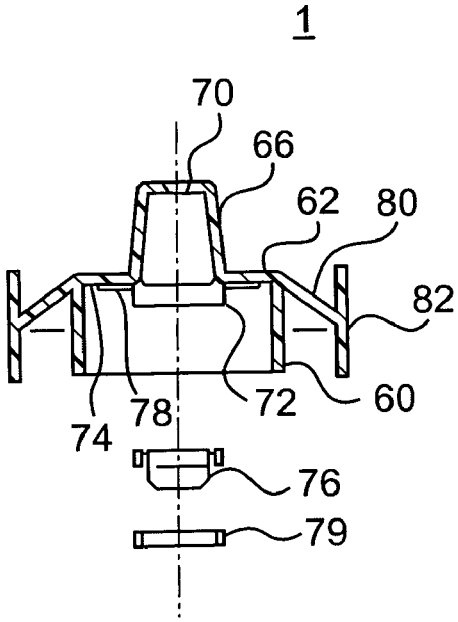
FIG. 5 is a cross-sectional exploded view of a unitary embodiment.

FIG. 5 is an exploded cross sectional form of a further embodiment of the drinking adapter 1. In this embodiment, the drinking adapter 1 has a substantially right cylindrical cap 60, which may be threaded. The cap 60 has a top 62 through which a mouthpiece 68, having an aperture 70 projects. The mouthpiece is preferably cylindrical, and tapered slightly to a smaller size as it approaches the aperture 70.

Concentric with the mouthpiece 68 and radially inwardly thereof is an annular flange 72 projecting downwardly from a lower surface 74 of the top 62 of the cap 60. An elastomeric valve 76 is received over the annular flange 72. A retaining ring 79, preferably of plastic fits over side walls of the valve 76 to retain the valve 76 on the annular flange 72.

Also on the lower surface 74 is an annular boss 78. The annular boss 78 cooperates with the neck 22 (FIG. 2) of the beverage container 3 for aiding in sealing. Support member 80 projects radially from the cap 60, terminating at a handle 82. In this embodiment, components corresponding to the handle 40 and lower member of the cap member 16 (FIG. 2) are unitary.

Figure 6:
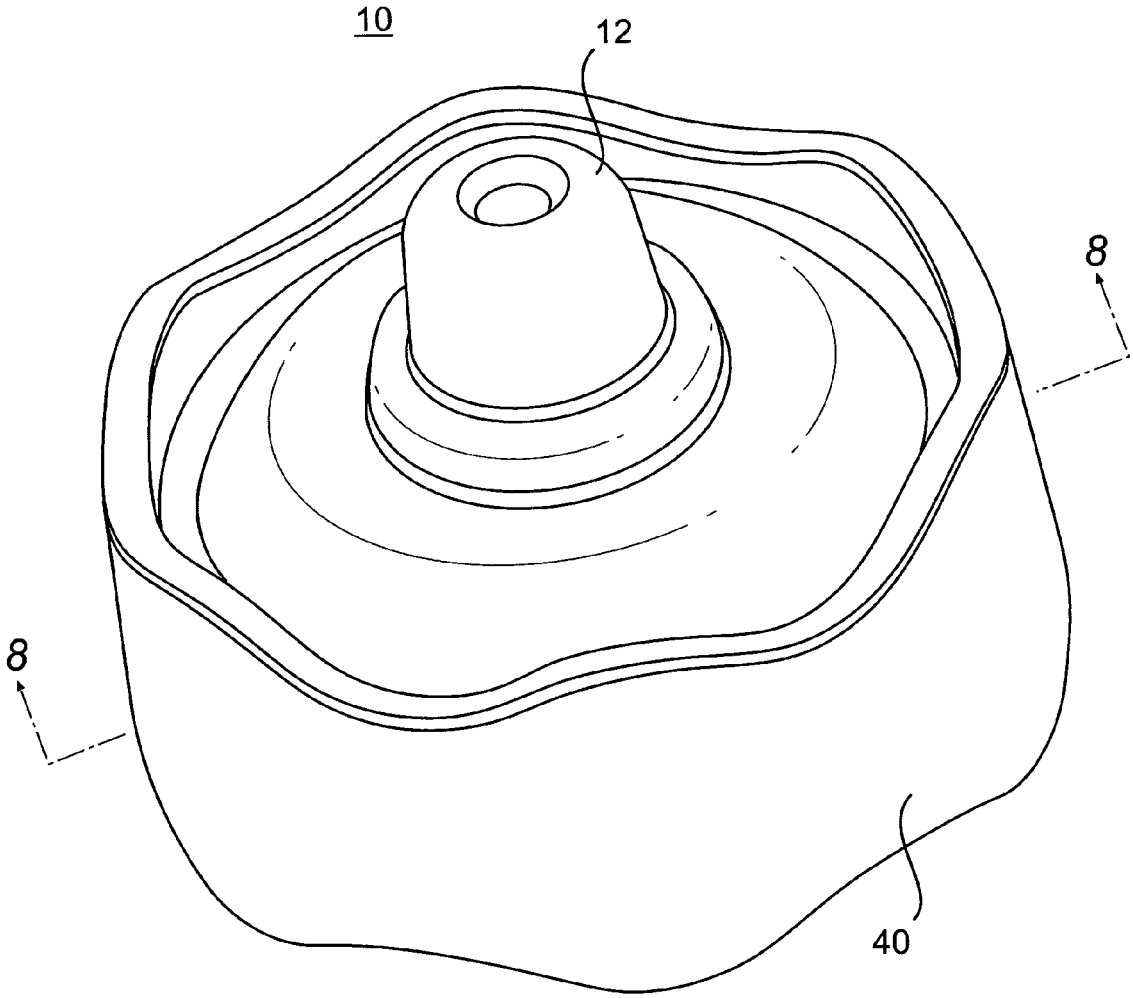
FIGS. 6 and 7 are upper and lower axonometric views of a further unitary embodiment.
Figure 8:
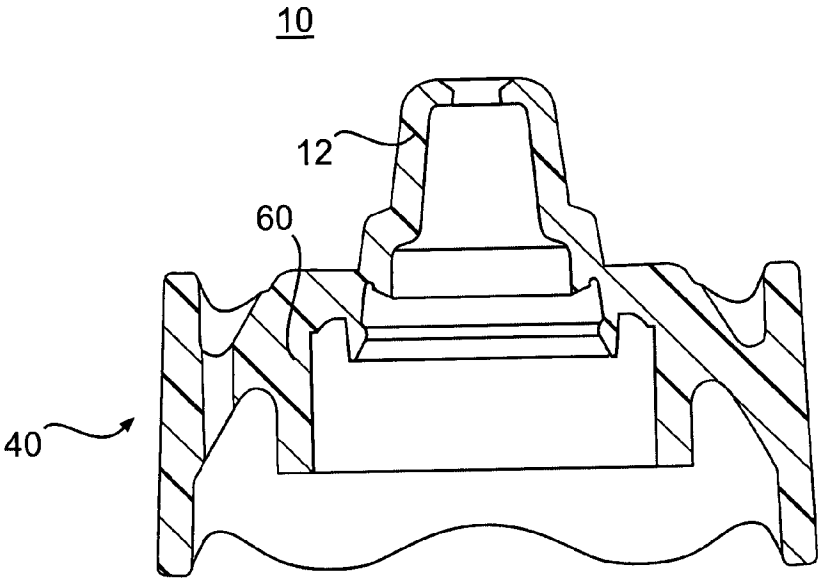
FIG. 8 is a cross-section taken along lines 8—8 of FIG. 6.
Figure 7:
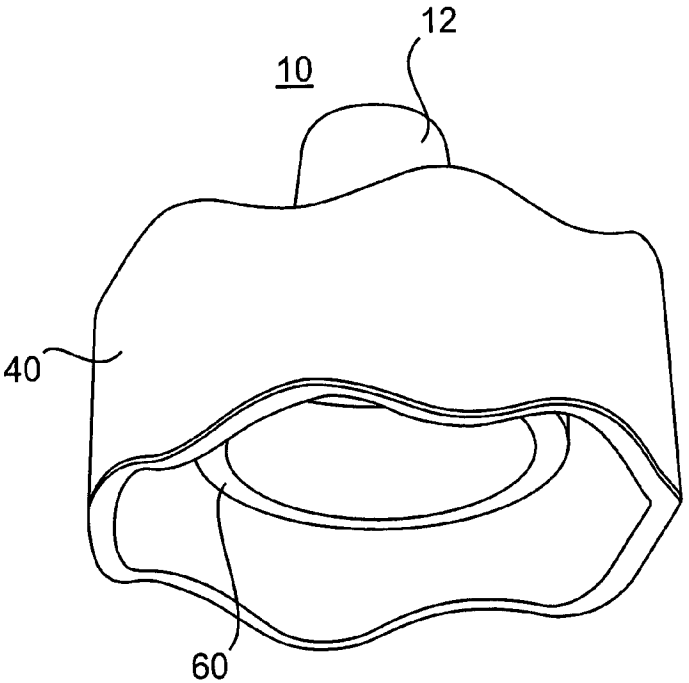

FIGS. 6, 7 and 8 illustrate a further unitary embodiment. The same reference numerals are used to denote elements corresponding to those of FIG. 5. FIGS. 6 and 7 are upper and lower axonometric views of a further unitary embodiment, and FIG. 8 is a cross-section taken along lines 8—8 of FIG. 6.

Figure 9:
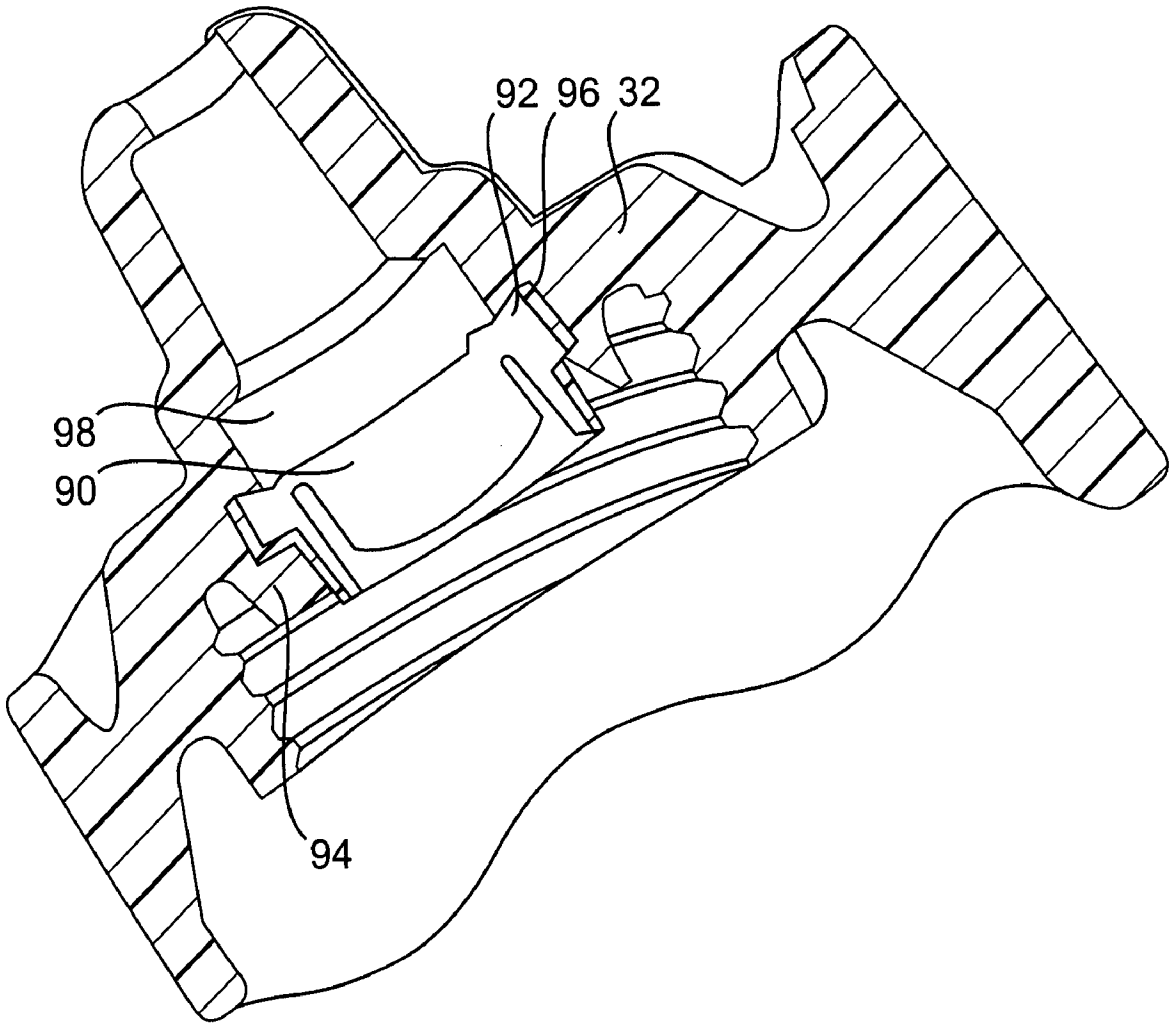
FIG. 9 is a cross-sectional view similar to that of FIG. 8 of a further embodiment.

FIG. 9 is a cross-sectional illustration of an embodiment using an alternative form of valve. In this embodiment, an elastomeric valve 90 comprises an outer cylindrical member 92. The cap 16 includes a central cylindrical portion 94, which may be coaxial with the cap 16. The cylindrical portion 94 includes an annular recess 96 which is axially offset from and radially surrounds an aperture 98 in the upper surface 32 of the cap 16. The valve 90 may take any number of known forms. The valve 90 could, for example, be constructed as disclosed in U.S. Pat. No. 5,213,236. The drinking adapter 1 may be readily assembled by deforming a valve 90 to deform the outer cylindrical member to fit radially inwardly of the annual recess 96. Then the valve 90 is released, and the outer cylindrical member 92 is fit into the annular recess 96. Simplified assembly is achieved.

What is thus provided is a versatile highly manufacturable system which may be used in an assembly with prior art drink containers. Use of the system U.S. Pat. No. 5,213,236. The drinking adapter 1 may be readily assembled by deforming a valve 90 to deform the outer cylindrical member to fit radially inwardly of the annual recess 96. Then the valve 90 is released, and the outer cylindrical member 92 is fit into the annular recess 96. Simplified assembly is achieved.

What is thus provided is a versatile highly manufacturable system which may be used in an assembly with prior art drink containers. Use of the system eases the burden on a parent when taking a child out. The specification has been written with a view toward enabling those skilled in the art to provide many forms of drinking system and assembly constructed in accordance with the present invention.

What is claimed is:

1. A drinking adaptor comprising: a closure member comprising a cap and a mouthpiece, said cap formed for releasably engaging a beverage container opening, said cap having a portion communicating an interior of the beverage container with a volume beyond said cap; said mouthpiece being supported in a fixed spatial relationship to said cap and enclosing the volume beyond said cap; and a handle supported to and fixed with respect to said closure member, said handle being radially displaced from said closure member, said handle comprising a cylindrical ring surrounding said cap.

2. The drinking adapter of claim 1 comprising a support member intermediate said closure member and said handle.

3. The drinking adapter according to claim 2 wherein an interior of said cap comprises a thread for engaging and closing a container.

4. The drinking adapter according to claim 2 wherein an interior of said cap comprises a thread for engaging and closing a container.

5. The drinking adapter according to claim 4 wherein said closure member, handle and support member comprise a unitary molded piece.

6. A unitary closure member for mating with a beverage bottle, said closure member comprising a cylindrical cap having a cylindrical wall and a top, a mouthpiece extending from said top, defining a central aperture in said top and a drinking aperture at an upper end of said mouthpiece, said mouthpiece being supported in a fixed spatial relationship to said cap and enclosing a volume beyond said cap, said mouthpiece further comprising an annular flange projecting into said cap and surrounding said central aperture; a support member projecting radially from said closure member; and an annular handle fixed to said support member and axially extending from said support member.

7. A unitary closure member for mating with a beverage bottle, said closure member comprising a cylindrical cap having a cylindrical wall and a top, a mouthpiece extending from said top, defining a central aperture in said top and a drinking aperture at an upper end of said mouthpiece, said mouthpiece further comprising an annular flange projecting into said cap and surrounding said central aperture; a support member projecting radially from said closure member; an annular handle axially extending from said support member, and further comprising an elastomeric valve having a central portion received in said annular flange and a radially outward portion surrounding said annular flange and a retaining ring retaining said valve on said annular flange.

8. The assembly according to claim 7 wherein said valve is deformable in response to suction applied from said mouthpiece to permit fluid to flow through said cap to said mouthpiece.

9. The assembly of claim 6 wherein said inner cylindrical surface of said cap comprises a thread.

10. A drinking system comprising a beverage bottle and a drinking adapter, said drinking adapter comprising: a closure member comprising a cap and a mouthpiece, said cap formed for releasably engaging a beverage container opening, said cap having a surface with an aperture communicating an interior of the beverage container with a volume beyond said cap; said mouthpiece being supported in a fixed spatial relationship to said cap and enclosing the volume beyond said cap; and a handle supported to and fixed with respect to said closure member, said handle being radially displaced from said closure member and surrounding at least a portion of said closure member, wherein said cap comprises a cylindrical wall and a top, said mouthpiece extending from said top and defining a central aperture in said top and a drinking aperture at an upper end of said mouthpiece, said mouthpiece further comprising an annular flange projecting into said cap and surrounding said central aperture; and further comprising an elastomeric valve having a central portion received in said annular flange and a radially outward portion surrounding said annular flange and wherein said handle is annular.

* * * * *

UNITED STATES PATENT AND TRADEMARK OFFICE

CERTIFICATE OF CORRECTION

PATENT NO. : 6,942,121 B1
DATED : September 13, 2005
INVENTOR(S) : Northup et al.

It is certified that error appears in the above-identified patent and that said Letters Patent is hereby corrected as shown below:

Column 5,
Line 3, please delete "2" and replace with -- 1 --.

Signed and Sealed this

Thirteenth Day of December, 2005

JON W. DUDAS
*Director of the United States Patent and Trademark Office*